US005586214A

United States Patent [19]

Eckman

[11] Patent Number: 5,586,214

[45] Date of Patent: Dec. 17, 1996

[54] IMMERSION HEATING ELEMENT WITH ELECTRIC RESISTANCE HEATING MATERIAL AND POLYMERIC LAYER DISPOSED THEREON

[75] Inventor: Charles M. Eckman, Dallas, Pa.

[73] Assignees: Energy Convertors, Inc., Dallas, Pa.; Rheem Manufacturing Co., New York, N.Y.

[21] Appl. No.: 365,920

[22] Filed: Dec. 29, 1994

[51] Int. Cl.[6] ..... H05B 3/78; H05B 3/28

[52] U.S. Cl. ..... 392/503; 392/500; 219/523; 219/544

[58] Field of Search ..... 392/451, 454, 392/455, 466, 487, 489, 503, 501, 500, 498, 497; 219/523, 544

[56] References Cited

U.S. PATENT DOCUMENTS

| | | | |
|---|---|---|---|
| 1,043,922 | 11/1912 | Gold | 219/523 |
| 2,146,402 | 2/1939 | Morgan | 219/523 |
| 3,614,386 | 10/1971 | Hepplewhite . | |
| 3,621,566 | 11/1971 | Welsh . | |
| 3,683,361 | 8/1972 | Salzwedel | 338/322 |
| 3,860,787 | 1/1975 | Strobach . | |
| 3,927,300 | 12/1975 | Wada et al. . | |
| 3,943,328 | 3/1976 | Cunningham . | |
| 3,952,182 | 4/1976 | Flanders . | |
| 4,326,121 | 4/1982 | Welsby et al. | 219/523 |
| 4,354,096 | 10/1982 | Dumas | 219/523 |
| 4,436,988 | 3/1984 | Blumenkranz | 219/544 |
| 4,687,905 | 8/1987 | Cunningham et al. . | |
| 4,707,590 | 11/1987 | Lefebvre | 219/523 |
| 5,013,890 | 5/1991 | Gamble | 392/497 |
| 5,129,033 | 7/1992 | Ferrara et al. | 392/447 |
| 5,155,800 | 10/1992 | Rezabek e al. | 392/503 |

FOREIGN PATENT DOCUMENTS

| | | | |
|---|---|---|---|
| 3512659 | 10/1986 | Germany | 392/497 |
| 53-134245 | 11/1978 | Japan . | |
| 3-129694 | 6/1991 | Japan . | |
| 7-211438 | 8/1995 | Japan . | |
| 14562 | 9/1913 | United Kingdom | 392/497 |
| 1070849 | 6/1967 | United Kingdom | 392/503 |
| 1325084 | 8/1973 | United Kingdom | 392/503 |
| 1498792 | 1/1978 | United Kingdom | 392/501 |
| 2244898 | 12/1991 | United Kingdom . | |

OTHER PUBLICATIONS

"Polymers", *Guide to Selecting Engineered Materials*, a special issue of *Advanced Materials & Processes*, Metals Park, OH, ASM International, 1989, pp. 92–93.

"Makroblend Polycarbonate Blend, Tedur Polyphenylene Sulfide", *Machine Design: Basics of Design Engineering*, Cleveland, OH, Penton Publishing, Inc., Jun. 1991, pp. 820–821, 863, 866–867.

*Primary Examiner*—John A. Jeffery

*Attorney, Agent, or Firm*—Duane Morris & Heckscher

[57] ABSTRACT

Polymeric heating elements and water heaters containing these elements are provided by this invention which utilize polymeric materials in contact with electric resistance heating materials and in contact with fluid to be heated. These polymeric materials also provide a substantially self-supporting structure for the resistance heating material. The heating elements include an electrically conductive resistance material capable of heating fluid when energized. The winding is insulated and protected by a polymer layer integrally disposed over the resistance material. The elements are lightweight, inexpensive to produce and use, and minimize galvanic corrosion and lime depositing without sacrificing heating capacity.

35 Claims, 4 Drawing Sheets

HEATING ELEMENT 100

IMMERSION HEATING ELEMENT WITH ELECTRIC RESISTANCE HEATING MATERIAL AND POLYMERIC LAYER DISPOSED THEREON

FIELD OF THE INVENTION

This invention relates to electric resistance heating elements, and more particularly, to polymerbased resistance heating elements for heating gases and liquids.

BACKGROUND OF THE INVENTION

Electric resistance heating elements used in connection with water heaters have traditionally been made of metal and ceramic components. A typical construction includes a pair of terminal pins brazed to the ends of an Ni—Cr coil, which is then disposed axially through a U-shaped tubular metal sheath. The resistance coil is insulated from the metal sheath by a powdered ceramic material, usually magnesium oxide.

While such conventional heating elements have been the workhorse for the water heater industry for decades, there have been a number of widely-recognized deficiencies. For example, galvanic currents occurring between the metal sheath and any exposed metal surfaces in the tank can create corrosion of the various anodic metal components of the system. The metal sheath of the heating element, which is typically copper or copper alloy, also attracts lime deposits from the water, which can lead to premature failure of the heating element. Additionally, the use of brass fittings and copper tubing has become increasingly more expensive as the price of copper has increased over the years.

As an alternative to metal elements, at least one plastic sheath electric heating element has been proposed in Cunningham, U.S. Pat. No. 3,943,328. In the disclosed device, conventional resistance wire and powdered magnesium oxide are used in conjunction with a plastic sheath. Since this plastic sheath is nonconductive, there is no galvanic cell created with the other metal parts of the heating unit in contact with the water in the tank, and there is also no lime buildup. Unfortunately, for various reasons, these prior art, plastic-sheath heating elements were not capable of attaining high wattage ratings over a normal useful service life, and concomitantly, were not widely accepted.

SUMMARY OF THE INVENTION

This invention provides polymeric electric resistance heating elements and water heaters containing such elements. The preferred element contains an electrically conductive, resistance heating material having a pair of free ends joined to a pair of terminal end portions. The resistance heating material is hermetically insulated within an integral layer of a polymeric material. The resistance material and polymer layer together form the heart of a novel heating element which provides resistance heating sufficient to heat a quantity of water to a temperature of at least about 120° F. without melting the polymeric layer.

The heating elements of this invention are most suitable in the service of heating hot water for commercial and residential use. They are designed to produce at least about 100–1200 W for heating a gaseous fluid medium, and about 1000 to about 6000 watts ("W"), and preferably about 1700–4500 W for heating a liquid fluid medium. This power is created without damaging the polymeric coating or the storage tank, of a water heater, for example, even in the case where the tank is made of plastic. Although this invention is not limited to any particular theory, it is believed that the cooling effect of the fluid medium, which can be oil, air, or water, maintains the polymeric layer below its melting point, enabling it to transmit convective heat from the resistance heating material without melting.

To effectively heat water to useful temperatures of about 120°–180° F., the polymeric coating should be as thin as possible, preferably less than 0.5 inches, and ideally less than about 0.1 inches. This enables the coating to provide a hermetic seal against electrical shorts without providing so much mass as to detract from the heat conductance efficiency of the element. The polymeric coating should be uniform and substantially bubble-free so as to avoid the occurrence of hot spots along the element, which could lead to premature failure in liquid environments.

In a more detailed embodiment of this invention, an electrical resistance heating element for use in heating a fluid medium is provided. The heating element contains a helical coil of a folded resistance wire having a pair of free end portions. The helical coil is hermetically encapsulated in a high temperature polymer. The element exhibits a tubular form having an open end and a closed end. The closed end comprises a threaded flange connector and at least a pair of conductors connected to the free ends of the resistance wire and extending from the threaded flange connector out of the element for connecting to a source of electric power. The heating element further includes a high temperature cut-off device which is capable of discontinuing electrical energy flowing through the element upon overheating, melting of the polymer, or the occurrence of an electrical short.

A BRIEF DESCRIPTION OF THE DRAWINGS

The accompanying drawings illustrate preferred embodiments of the invention, as well as other information pertinent to the disclosure, in which:

FIG. 1: is a perspective view of a preferred polymeric fluid heater of this invention;

FIG. 2: is a left side, plan view of the polymeric fluid heater of FIG. 1;

FIG. 3: is a front planar view, including partial cross-sectional and peel-away views, of the polymeric fluid heater of FIG. 1;

FIG. 4: is a front planar, cross-sectional view of a preferred inner mold portion of the polymeric fluid heater of FIG. 1;

FIG. 5: is a front planar, partial cross-sectional view of a preferred termination assembly for the polymeric fluid heater of FIG. 1;

FIG. 6: is a enlarged partial front planar view of the end of a preferred coil for a polymeric fluid heater of this invention; and FIG. 7: is a enlarged partial front planar view of a dual coil embodiment for a polymeric fluid heater of this invention.

DETAILED DESCRIPTION OF THE INVENTION

This invention provides electrical resistance heating elements and water heaters containing these elements. These devices are useful in minimizing galvanic corrosion within water and oil heaters, as well as lime buildup and problems of shortened element life. As used herein, the terms "fluid" and "fluid medium" apply to both liquids and gases.

Figure 1:
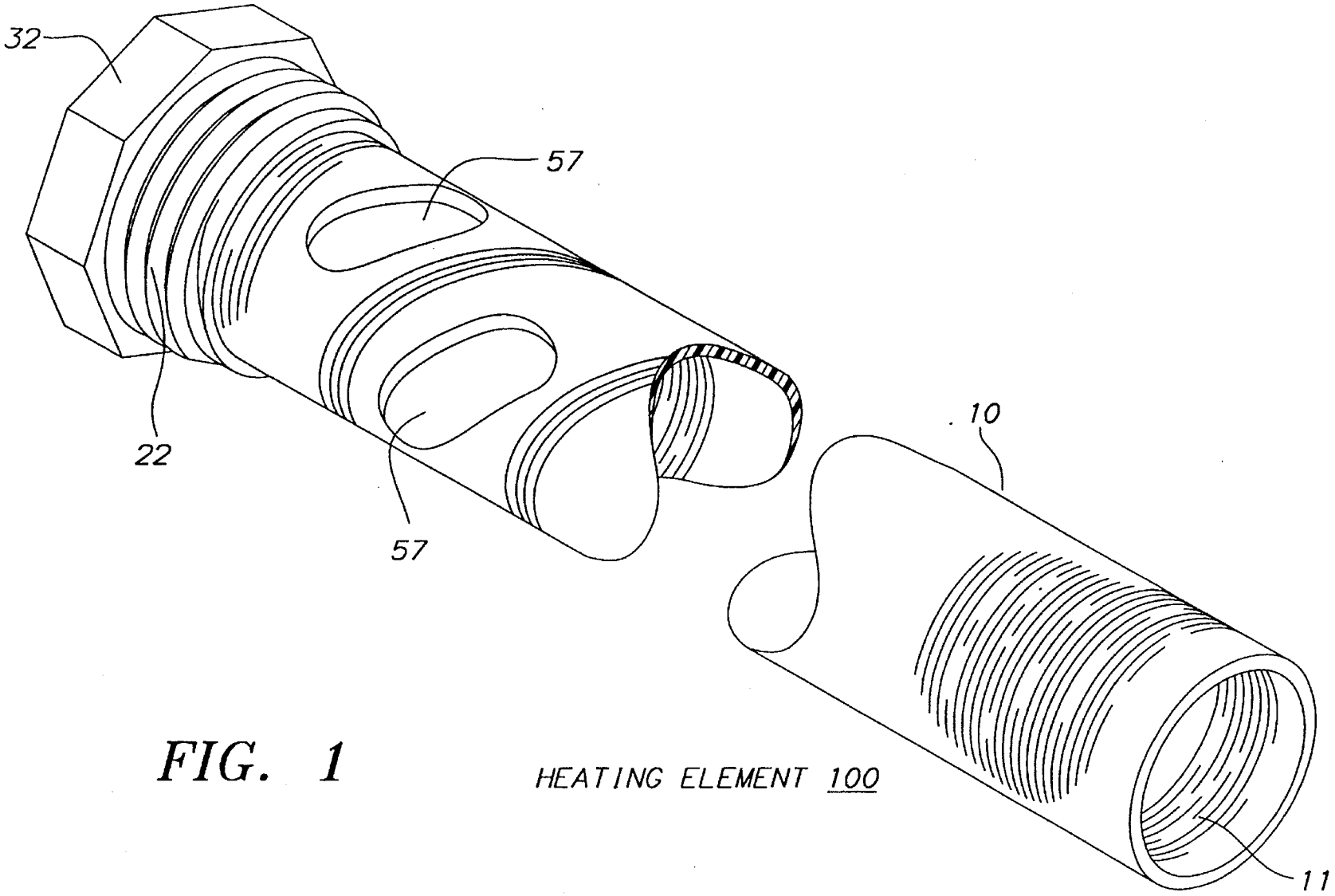
Figure 2:
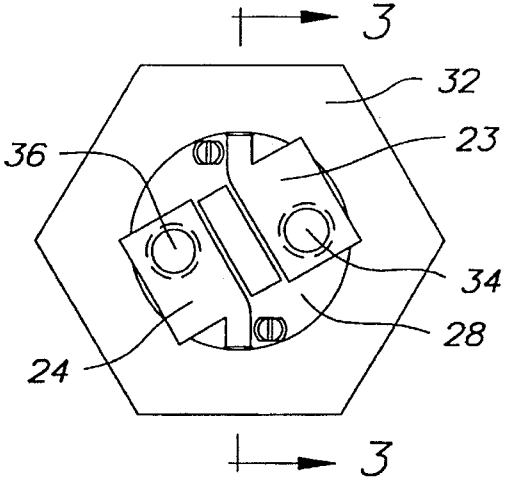
Figure 3:
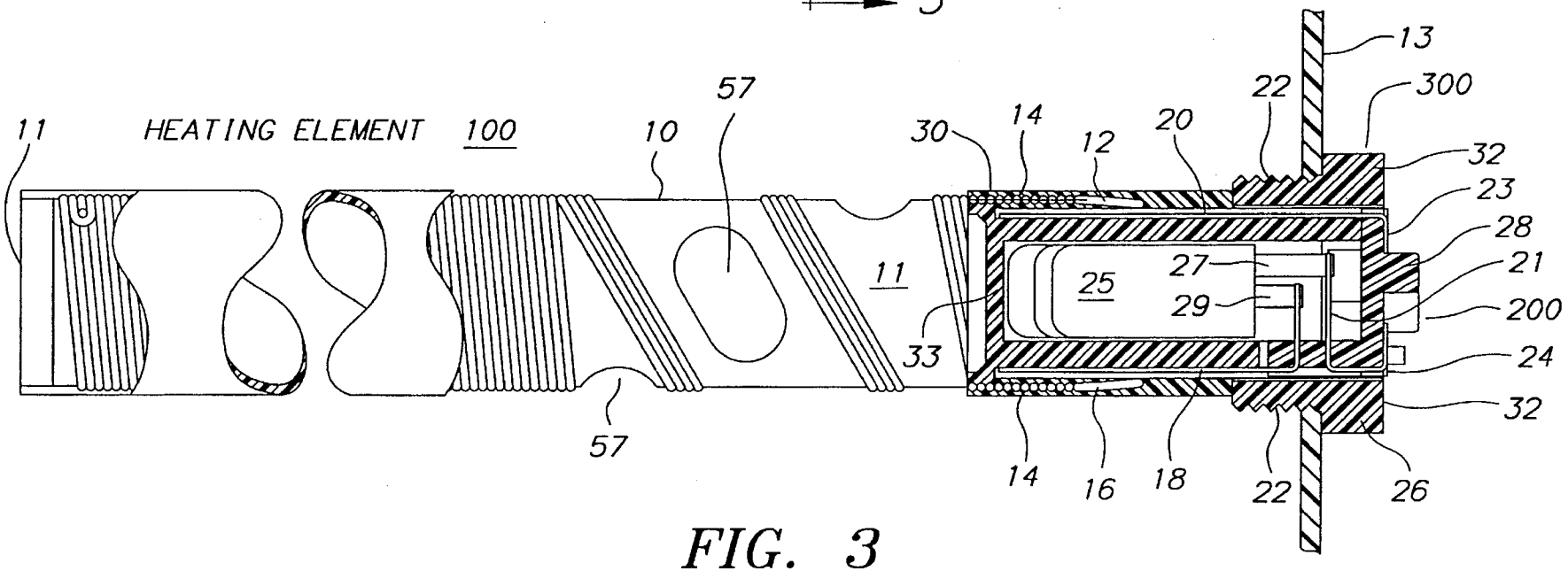

With reference to the drawings, and particularly with reference to FIGS. 1—3 thereof, there is shown a preferred polymeric fluid heater 100 of this invention. The polymeric fluid heater 100 contains an electrically conductive, resistance heating material. This resistance heating material can be in the form of a wire, mesh, ribbon, or serpentine shape, for example. In the preferred heater 100, a coil 14 having a pair of free ends joined to a pair of terminal end portions 12 and 16 is provided for generating resistance heating. Coil 14 is hermetically and electrically insulated from fluid with an integral layer of a high temperature polymeric material. In other words, the active resistance heating material is protected from shorting out in the fluid by the polymeric coating. The resistance material of this invention is of sufficient surface area, length or cross-sectional thickness to heat water to a temperature of at least about 120° F. without melting the polymeric layer. As will be evident from the below discussion, this can be accomplished through carefully selecting the proper materials and their dimensions.

Figure 4:
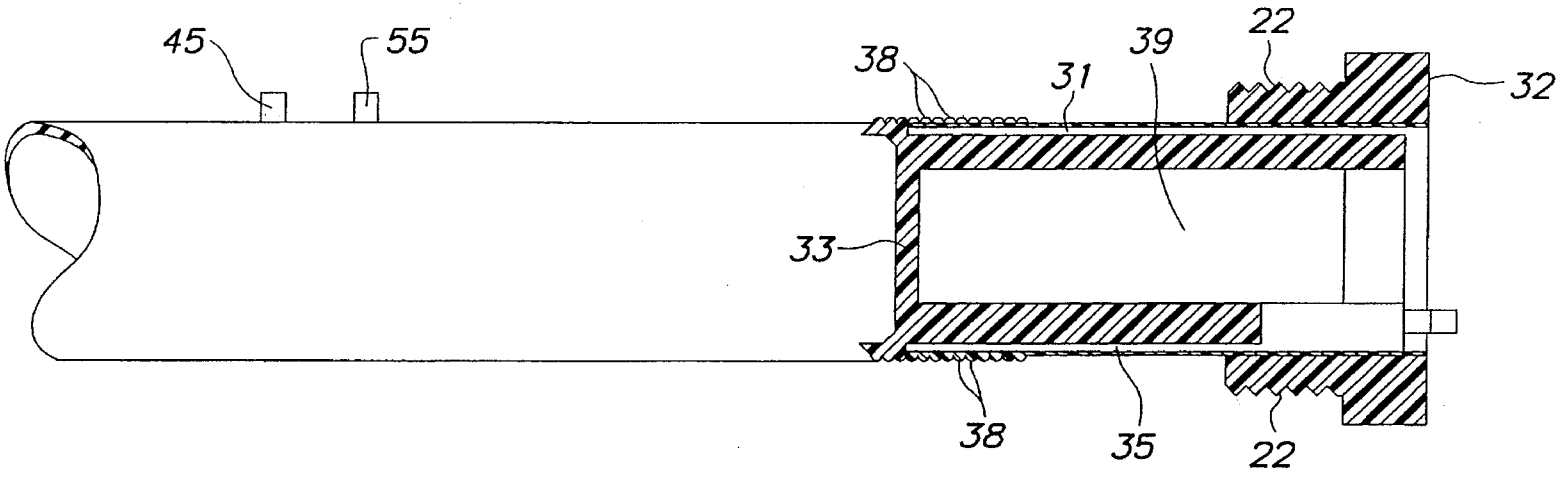
Figure 5:
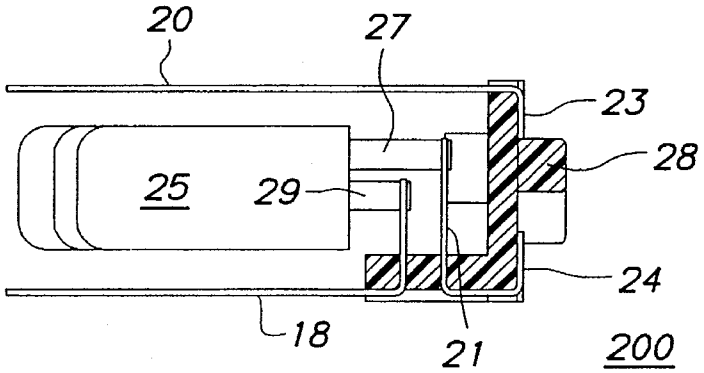

With reference to FIG. 3 in particular, the preferred polymeric fluid heater 100 generally comprises three integral parts: a termination assembly 200, shown in FIG. 5, a inner mold 300, shown in FIG. 4, and a polymer coating 30. Each of these subcomponents, and their final assembly into the polymeric fluid heater 100 will now be further explained.

The preferred inner mold 300, shown in FIG. 4, is a single-piece injection molded component made from a high temperature polymer. The inner mold 300 desirably includes a flange 32 at its outermost end. Adjacent to the flange 32 is a collar portion having a plurality of threads 22. The threads 22 are designed to fit within the inner diameter of a mounting aperture through the side wall of a storage tank, for example in a water heater tank 13. An O-ring (not shown) can be employed on the inside surface of the flange 32 to provide a surer water-tight seal. The preferred inner mold 300 also includes a thermistor cavity 39 located within its preferred circular cross-section. The thermistor cavity 39 can include an end wall 33 for separating the thermistor 25 from fluid. The thermistor cavity 39 is preferably open through the flange 32 so as to provide easy insertion of the termination assembly 200. The preferred inner mold 300 also contains at least a pair of conductor cavities 31 and 35 located between the thermistor cavity and the outside wall of the inner mold for receiving the conductor bar 18 and terminal conductor 20 of the termination assembly 200. The inner mold 300 contains a series of radial alignment grooves 38 disposed around its outside circumference. These grooves can be threads or unconnected trenches, etc., and should be spaced sufficiently to provide a seat for electrically separating the helices of the preferred coil 14.

The preferred inner mold 300 can be fabricated using injection molding processes. The flow-through cavity 11 is preferably produced using a 12.5 inch long hydraulically activated core pull, thereby creating an element which is about 13–18 inches in length. The inner mold 300 can be filled in a metal mold using a ring gate placed opposite from the flange 32. The target wall thickness for the active element portion 10 is desirably less than 0.5 inches, and preferably less than 0.1 inches, with a target range of about 0.04–0.06 inches, which is believed to be the current lower limit for injection molding equipment. A pair of hooks or pins 45 and 55 are also molded along the active element development portion 10 between consecutive threads or trenches to provide a termination point or anchor for the helices of one or more coils. Side core pulls and an end core pull through the flange portion can be used to provide the thermistor cavity 39, flow-through cavity 11, conductor cavities 31 and 35, and flow-through apertures 57 during injection molding.

With reference to FIG. 5, the preferred termination assembly 200 will now be discussed. The termination assembly 200 comprises a polymer end cap 28 designed to accept a pair of terminal connections 23 and 24. As shown in FIG. 2, the terminal connections 23 and 24 can contain threaded holes 34 and 36 for accepting a threaded connector, such as a screw, for mounting external electrical wires. The terminal connections 23 and 24 are the end portions of terminal conductor 20 and thermistor conductor bar 21. Thermistor conductor bar 21 electrically connects terminal connection 24 with thermistor terminal 27. The other thermistor terminal 29 is connected to thermistor conductor bar 18 which is designed to fit within conductor cavity 35 along the lower portion of FIG. 4. To complete the circuit, a thermistor 25 is provided. Optionally, the thermistor 25 can be replaced with a thermostat, a solid-state TCO or merely a grounding band that is connected to an external circuit breaker, or the like. It is believed that the grounding band (not shown) could be located proximate to one of the terminal end portions 16 or 12 so as to short-out during melting of the polymer.

In the preferred environment, thermistor 25 is a snap-action thermostat/thermoprotector such as the Model W Series sold by Portage Electric. This thermoprotector has compact dimensions and is suitable for 120/240 VAC loads. It comprises a conductive bi-metallic construction with an electrically active case. End cap 28 is preferably a separate molded polymeric part.

After the termination assembly 200 and inner mold 300 are fabricated, they are preferably assembled together prior to winding the disclosed coil 14 over the alignment grooves 38 of the active element portion 10. In doing so, one must be careful to provide a completed circuit with the coil terminal end portions 12 and 16. This can be assured by brazing, soldering or spot welding the coil terminal end portions 12 and 16 to the terminal conductor 20 and thermistor conductor bar 18. It is also important to properly locate the coil 14 over the inner mold 300 prior to applying the polymer coating 30. In the preferred embodiment, the polymer coating 30 is over-extruded to form a thermoplastic polymeric bond with the inner mold 300. As with the inner mold 300, core pulls can be introduced into the mold during the molding process to keep the flow-through apertures 57 and flow-through cavity 11 open.

Figure 6:
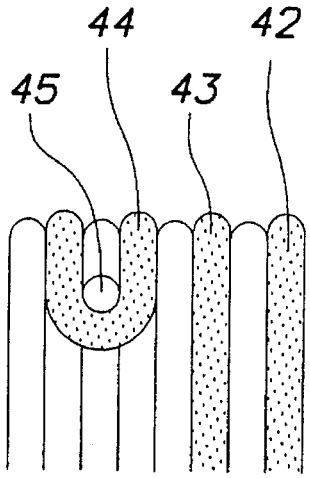
Figure 7:
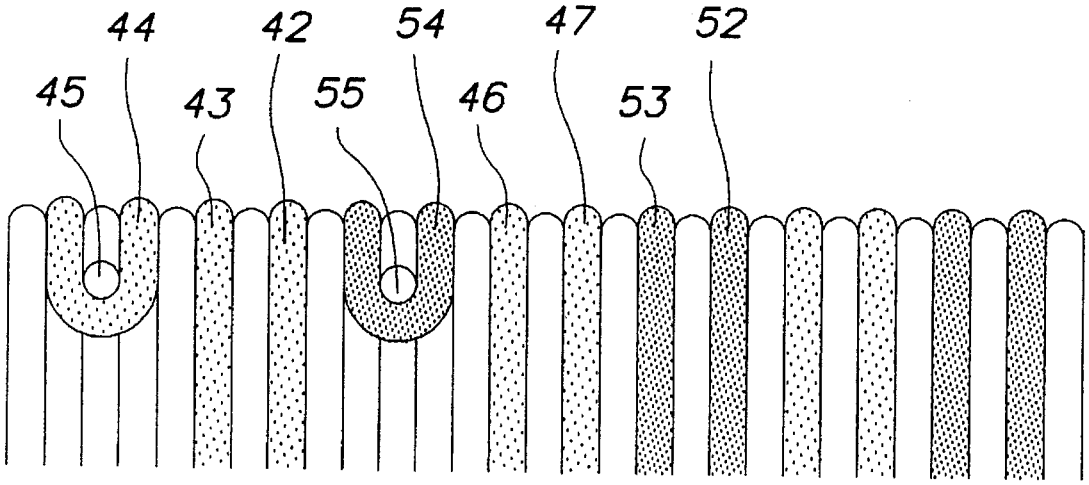

With respect to FIGS. 6 and 7, there are shown single and double resistance wire embodiments for the polymeric resistance heating elements of this invention. In the single wire embodiment shown in FIG. 6, the alignment grooves 38 of the inner mold 300 are used to wrap a first wire pair having helices 42 and 43 into a coil form. Since the preferred embodiment includes a folded resistance wire, the end portion of the fold or helix terminus 44 is capped by folding it around pin 45. Pin 45 ideally is part of, and injection molded along with, the inner mold 300.

Similarly, a dual resistance wire configuration can be provided. In this embodiment, the first pair of helices 42 and 43 of the first resistance wire are separated from the next consecutive pair of helices 46 and 47 in the same resistance wire by a secondary coil helix terminus 54 wrapped around a second pin 55. A second pair of helices 52 and 53 of a second resistance wire, which are electrically connected to the secondary coil helix terminus 54, are then wound around the inner mold 300 next to the helices 46 and 47 in the next adjoining pair of alignment grooves. Although the dual coil assembly shows alternating pairs of helices for each wire, it is understood that the helices can be wound in groups of two or more helices for each resistance wire, or in irregular numbers, and winding shapes as desired, so long as their conductive coils remain insulated from one another by the inner mold, or some other insulating material, such as separate plastic coatings, etc.

The plastic parts of this invention preferably include a "high temperature" polymer which will not deform significantly or melt at fluid medium temperatures of about 120°–180° F. Thermoplastic polymers having a melting temperature greater than 200° F. are most desirable, although certain ceramics and thermosetting polymers could also be useful for this purpose. Preferred thermoplastic material can include: fluorocarbons, polyaryl-sulphones, polyimides, polyetheretherketones, polyphenylene sulphides, polyether sulphones, and mixtures and copolymers of these thermoplastics. Thermosetting polymers which would be acceptable for such applications include certain epoxies, phenolics, and silicones. Liquid-crystal polymers can also be employed for improving high temperature chemical processing.

In the preferred embodiment of this invention, polyphenylene sulphide ("PPS") is most desirable because of its elevated temperature service, low cost and easier processability, especially during injection molding.

The polymers of this invention can contain up to about 5–40 wt.% percent fiber reinforcement, such as graphite, glass or polyamide fiber. These polymers can be mixed with various additives for improving thermal conductivity and mold-release properties. Thermal conductivity can be improved with the addition of carbon, graphite and metal powder or flakes. It is important however that such additives are not used in excess, since an overabundance of any conductive material may impair the insulation and corrosion-resistance effects of the preferred polymer coatings. Any of the polymeric elements of this invention can be made with any combination of these materials, or selective ones of these polymers can be used with or without additives for various parts of this invention depending on the end-use for the element.

The resistance material used to conduct electrical current and generate heat in the fluid heaters of this invention preferably contains a resistance metal which is electrically conductive, and heat resistant. A popular metal is Ni—Cr alloy although certain copper, steel and stainless-steel alloys could be suitable. It is further envisioned that conductive polymers, containing graphite, carbon or metal powders or fibers, for example, used as a substitute for metallic resistance material, so long as they are capable of generating sufficient resistance heating to heat fluids, such as water. The remaining electrical conductors of the preferred polymeric fluid heater 100 can also be manufactured using these conductive materials.

The standard rating of the preferred polymeric fluid heaters of this invention used in heating water is 240 V and 4500 W, although the length and wire diameter of the conducting coils 14 can be varied to provide multiple ratings from 1000 W to about 6000 W, and preferably between about 1700 W and 4500 W. For gas heating, lower wattages of about 100–1200 W can be used. Dual, and even triple wattage capacities can be provided by employing multiple coils or resistance materials terminating at different portions along the active element portion 10.

From the foregoing, it can be realized that this invention provides improved fluid heating elements for use in all types of fluid heating devices, including water heaters and oil space heaters. The preferred devices of this invention are mostly polymeric, so as to minimize expense, and to substantially reduce galvanic action within fluid storage tanks. In certain embodiments of this invention, the polymeric fluid heaters can be used in conjunction with a polymeric storage tank so as to avoid the creation of metal ion-related corrosion altogether.

Alternatively, these polymeric fluid heaters can be designed to be used separately as their own storage container to simultaneously store and heat gases or fluid. In such an embodiment, the flow-through cavity 11 could be molded in the form of a tank or storage basin, and the heating coil 14 could be contained within the wall of the tank or basin and energized to heat a fluid or gas in the tank or basin. The heating devices of this invention could also be used in food warmers, curler heaters, hair dryers, curling irons, irons for clothes, and recreational heaters used in spas and pools.

This invention is also applicable to flow-through heaters in which a fluid medium is passed through a polymeric tube containing one or more of the windings or resistance materials of this invention. As the fluid medium passes through the inner diameter of such a tube, resistance heat is generated through the tube's inner diameter polymeric wall to heat the gas or liquid. Flow-through heaters are useful in hair dryers and in "on-demand" heaters often used for heating water.

Although various embodiments have been illustrated, this is for the purpose of describing and not limiting the invention. Various modifications, which will become apparent to one skilled in the art, or within the scope of this invention described in the attached claims.

What is claimed is:

1. An electrical resistance heating device for heating a fluid medium comprising:

an electrically conductive, resistance heating member having a pair of free ends joined to a pair of terminal end portions, said resistance heating member being fully supported by and encapsulated within an integral layer of an electrically insulating, thermally conductive, injection molded, polymeric material whereby said polymeric material is in direct contact with said fluid medium, and will not melt when heating said fluid medium.

2. The heating device of claim 1, wherein said polymeric material has a melting point of at least about 200° F.

3. The heating device of claim 1, wherein said polymeric material including graphite, glass or polyamide fiber reinforcement.

4. The heating device of claim 1, wherein said polymeric material comprises at least in part a side wall of a water storage container.

5. The heating device of claim 1, further comprising a second electrically conductive, resistance heating member having a second wattage rating.

6. The electrical resistance heating device of claim 1, wherein said injection molded polymeric material comprises polyphenylene sulfide or a liquid crystal polymer.

7. The electrical resistance heating device of claim 6, wherein said injection molded polymeric material includes one or more additives to improve its thermal conductivity.

8. A water heater comprising:

a tank for containing water; and a heating element attached through a wall of said tank for providing electric resistance heating to a portion of the water in said storage tank, said heating element comprising an electrically conductive, resistance heating material capable of heating said portion of water when energized, and a polymeric hermetic material in contact with said resistance heating material and in contact with said water and electrically insulating said resistance heating material from said water, said polymeric hermetic material comprising a self supporting structure with said resistance heating material and effectively transferring heat generated by said resistance heating material to said water to raise the temperature of said water to at least 120° F. without melting.

9. The water heater of claim 8, wherein said tank comprises a polymer.

10. The water heater of claim 8, wherein said resistance heating material comprises a helical coil.

11. The water heater of claim 10, wherein said helical coil comprises a folded resistance metal wire having a pair of a free end portions located on a first end of said helical coil.

12. The water heater of claim 10, wherein said polymeric hermetic material comprises polyphenylene sulfide.

13. The water heater of claim 8, wherein said heating element comprises a tube having open and closed ends, said closed end comprising a threaded flange connector.

14. The water heater of claim 13, wherein said threaded flanged connector comprises a polymer.

15. The water heater of claim 8, wherein said polymeric hermetic material includes a fiber reinforcement.

16. The water heater of claim 8, wherein said polymeric material comprises an injection molded thermoplastic polymer.

17. The water heater of claim 8, wherein said polymeric hermetic material includes one or more additives to improve its thermal conductivity.

18. An electrical resistance heating element capable of being disposed through a wall of a tank for use in connection with heating a fluid medium, such as air or water, comprising:

a polymeric inner core comprising a tubular first end portion having an end opening therein, a cavity disposed proximally from said end opening and a flanged second end poriton;

a helical coil of a folded resistance wire having a pair of free end portions wound onto and self-supported by said polymeric under core to extend into said fluid medium along said tubular first end portion; and a polymeric coating in contact with said fluid and disposed over said helical coil to hermetically encapsulate said coil onto said polymeric inner core.

19. The heating element of claim 18, wherein said polymeric coating and said polymeric inner core comprise a common thermoplastic material having a melting point greater than 200° F.

20. The heating element of claim 19, wherein a portion of said polymeric coating is molded onto said helical coil in a thickness of no greater than about 0.5 inches.

21. The heating element of claim 20, wherein said polymeric coating portion comprises a substantially bubble-free injection molded layer.

22. The heating element of claim 20, wherein said polymeric coating portion comprises a thickness of less than about 0.1 inches.

23. The heating element of claim 18, wherein said polymeric inner core includes glass, graphite or polyamide fiber.

24. The electrical resistance heating element of claim 18, wherein said polymeric coating comprises polyphenylene sulfide or a liquid crystal polymer.

25. The electrical resistance heating element of claim 18, wherein said polymeric coating includes one or more additives to improve its thermal conductivity.

26. An electrical resistance heating element capable of being disposed through a wall of a tank for heating a fluid comprising:

an electrically conductive, resistance heating material having a pair of free ends joined to a pair of terminal end portions, said resistance heating material being hermetically insulated and encapsulated within a self-supporting polymeric material which is in contact with the fluid to be heated, said resistance heating material providing resistance heating through said polymeric material sufficient to generate at least about 1000 W to heat a quantity of said fluid to a temperature of at least about 120° F. without melting said polymeric material.

27. The electrical resistance heating element of claim 26, wherein said polymeric material comprises an injection molded polymer core.

28. The electrical resistance heating element of claim 27, wherein said polymeric core is tubular in shape with alignment grooves disposed thereon.

29. The electrical resistance heating element of claim 28, wherein said resistance heating material comprises a helical coil disposed in said alignment grooves.

30. The electrical resistance heating element of claim 26, wherein the polymeric material includes a pair of flow-through holes for circulating a fluid therethrough.

31. The electrical resistance heating element of claim 26, wherein said polymeric material comprises polyphenylene sulfide or a liquid crystal polymer.

32. The electrical resistance heating element of claim 31, wherein said polymeric material includes one or more additives to improve its thermal conductivity.

33. A method of resistance heating a fluid medium, comprising:

(a) providing an electrical resistance heating element containing an electrically conductive resistance heating material capable of heating said fluid medium when energized, and a polymeric material integrally encapsulating and self-supporting said resistance heating material to enable said resistance heating material to extend into and be substantially surrounded by said fluid medium;

(b) immersing said heating element through a wall of a tank and into said fluid medium, whereby said fluid medium comes in direct contact with said polymeric material to maintain said polymeric material below its melting point while absorbing heat generated by said resistance heating material which has been transferred through said polymeric material.

34. The method of claim 33, wherein said polymeric material is injection molded.

35. The method of resistance heating of claim 34, wherein said element has an open end for receiving said fluid medium, said fluid medium absorbing heat from said polymeric material on both an inside and an outside portion of said element.

* * * * *